US008698593B2

(12) United States Patent
Park et al.

(10) Patent No.: US 8,698,593 B2
(45) Date of Patent: Apr. 15, 2014

(54) CHIP RESISTOR AND METHOD OF MANUFACTURING THE SAME

(75) Inventors: Jang Ho Park, Gyunggi-do (KR); Young Key Kim, Seoul (KR); Ki Won Suh, Gyunggi-do (KR); Jang Seok Yun, Gyunggi-do (KR); Jin Man Han, Seoul (KR); Sung Jun Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/441,596

(22) Filed: Apr. 6, 2012

(65) Prior Publication Data

US 2013/0154790 A1 Jun. 20, 2013

(30) Foreign Application Priority Data

Dec. 19, 2011 (KR) ..... 10-2011-0137250

(51) Int. Cl.
*H01C 1/012* (2006.01)

(52) U.S. Cl.
USPC ..... 338/309; 338/307; 338/332

(58) Field of Classification Search
USPC ..... 338/307, 309, 332
See application file for complete search history.

(56) References Cited

U.S. PATENT DOCUMENTS

| | | | | | |
|---|---|---|---|---|---|
| 4,245,210 | A * | 1/1981 | Landry et al. | ..... | 338/314 |
| 4,647,900 | A * | 3/1987 | Schelhorn et al. | ..... | 338/314 |
| 5,680,092 | A * | 10/1997 | Yamada et al. | ..... | 338/309 |
| 5,907,274 | A * | 5/1999 | Kimura et al. | ..... | 338/309 |
| 6,314,637 | B1 * | 11/2001 | Kimura et al. | ..... | 29/620 |
| 6,943,662 | B2 * | 9/2005 | Tanimura | ..... | 338/309 |
| 7,238,296 | B2 * | 7/2007 | Moriya | ..... | 252/62.3 R |
| 7,782,173 | B2 * | 8/2010 | Urano et al. | ..... | 338/307 |
| 7,782,174 | B2 * | 8/2010 | Urano | ..... | 338/309 |

FOREIGN PATENT DOCUMENTS

| | | | |
|---|---|---|---|
| JP | 09-275002 | A | 10/1997 |
| JP | 2004-119561 | A | 4/2004 |
| JP | 2008-016645 | A | 1/2008 |

* cited by examiner

*Primary Examiner* — Kyung Lee
(74) *Attorney, Agent, or Firm* — McDermott Will & Emery LLP

(57) ABSTRACT

There is provided a chip resistor including a ceramic substrate; a first resistance layer formed on the ceramic substrate and including a first conductive metal and a first glass; and a second resistance layer formed on the first resistance layer, including a second conductive metal and a second glass, and having a smaller content of glass than the first resistance layer, thereby obtaining relatively low resistance and a relatively small temperature coefficient of resistance (TCR).

24 Claims, 2 Drawing Sheets

CHIP RESISTOR AND METHOD OF MANUFACTURING THE SAME

CROSS-REFERENCE TO RELATED APPLICATIONS

This application claims the priority of Korean Patent Application No. 10-2011-0137250 filed on Dec. 19, 2011, in the Korean Intellectual Property Office, the disclosure of which is incorporated herein by reference.

BACKGROUND OF THE INVENTION

1. Field of the Invention

The present invention relates to a chip resistor and a method of manufacturing the same.

2. Description of the Related Art

According to the related art, a resistor having low resistance ranging from 50 mΩ to 1Ω is manufactured through a thick film method. A resistor electrode is formed of a silver (Ag)-palladium (Pd) paste and a side electrode portion is formed of an Ag paste.

By changing the pattern sizes of the resistor electrode and the side electrode portion and adjusting Pd content of the Ag—Pd paste of the resistor electrode, a temperature coefficient of resistance (TCR) is adjusted.

In a plate-type metal method, resistance is adjusted by using a foil-type or a plate-type metal material having low resistance of 50 mΩ or less and a TCR of 500 ppm/K or less and processing the dimension and shape of a resistor.

However, since the plate-type metal method requires a metal plate and a mold according to the required resistance range and size of the plate-type metal material, manufacturing costs are increased when various types of products are manufactured, and it is difficult to mass-produce chip resistors, as compared with the thick film method, and material expense is high in a chip resistor due to high use and unit costs of raw materials.

In addition, as Pd content of Ag—Pd paste is increased, resistance is increased, but a TCR may be reduced. When this method is used, there is a limit in obtaining low resistance of 50 mΩ or less and a TCR of 500 ppm/K or less.

SUMMARY OF THE INVENTION

An aspect of the present invention provides a chip resistor having relatively low resistance and a relatively small temperature coefficient of resistance (TCR), and a method of manufacturing the same.

According to an aspect of the present invention, there is provided a chip resistor, including: a ceramic substrate; a first resistance layer formed on the ceramic substrate and including a first conductive metal and a first glass; and a second resistance layer formed on the first resistance layer, including a second conductive metal and a second glass, and having a smaller content of glass than the first resistance layer.

The second resistance layer may include two or more layers.

The first conductive metal may include a copper (Cu)-nickel (Ni) alloy.

The second conductive metal may include a Cu—Ni alloy.

The first and second conductive metals may have the same composition of the Cu—Ni alloy.

A content of Ni of the first and second conductive metals may range from 18 to 70 wt %.

A content of the first glass of the first resistance layer may be 3 to 40 parts by weight based on 100 parts by weight of the first conductive metal.

A thickness of the first resistance layer may range from 5 to 40 um.

A thickness of the second resistance layer may range from 10 to 70 um.

A total thickness of the first and second resistance layers may be equal to or smaller than 110 um.

The ceramic substrate may be an alumina substrate.

According to another aspect of the present invention, there is provided a chip resistor, including: a ceramic substrate; a first resistance layer formed on the ceramic substrate and including a first conductive metal and glass; and a second resistance layer that is formed on the first resistance layer, includes a second conductive metal, and does not include the glass.

The second resistance layer may include two or more layers.

The first conductive metal may include a Cu—Ni alloy.

The second conductive metal may include a Cu—Ni alloy.

The first and second conductive metals may have the same composition of the Cu—Ni alloy.

A content of Ni of the first and second conductive metals may range from 18 to 70 wt %.

A content of the glass of the first resistance layer may be 3 to 40 parts by weight based on 100 parts by weight of the first conductive metal.

A thickness of the first resistance layer may range from 5 to 40 um.

A thickness of the second resistance layer may range from 10 to 70 um.

A total thickness of the first and second resistance layers may be equal to or smaller than 110 um.

The ceramic substrate may be an alumina substrate.

According to another aspect of the present invention, there is provided a method of manufacturing a chip resistor, the method including forming a first resistance layer using a first conductive paste including a first conductive metal and a first glass, on a ceramic substrate; and forming a second resistance layer using a second conductive paste including a second conductive metal and a second glass on the first resistance layer, wherein a content of glass of the second conductive paste is smaller than the first conductive paste.

The ceramic substrate may be an alumina substrate.

The first conductive metal may include Cu and Ni.

The second conductive metal may include Cu and Ni.

A mean diameter of the Ni may be ½ or smaller than a mean diameter of the Cu.

The first and second conductive metals may have the same composition of Cu—Ni alloy.

A content of Ni of the first and second conductive metals may range from 18 to 70 wt %.

A content of the first glass may range from 3 to 40 parts by weight based on 100 parts by weight of the first conductive metal.

The first and second resistance layers may be formed by a printing method.

A mean diameter of the second conductive metal may be greater than a mean diameter of the first conductive metal.

The method may further include, after the forming of the second resistance layer, sintering the second resistance layer.

The sintering may be sequentially performed in an oxidation atmosphere and a reduction atmosphere.

The reduction atmosphere maybe a hydrogen atmosphere.

According to another aspect of the present invention, there is provided a method of manufacturing a chip resistor, the method including: forming a first resistance layer using a first conductive paste including a first conductive metal and glass, on a ceramic substrate; and forming a second resistance layer using a second conductive paste that includes a second conductive metal and does not include glass, on the first resistance layer.

The ceramic substrate may be an alumina substrate.

The first conductive metal may include Cu and Ni.

The second conductive metal may include Cu and Ni.

A mean diameter of powder particles of the Ni may be ½ or smaller than a mean diameter of powder particles of the Cu.

The first and second conductive metals may have the same composition of Cu—Ni alloy.

A content of Ni of the first and second conductive metals may range from 18 to 70 wt %.

The first and second resistance layers may be formed by a printing method.

A mean diameter of the second conductive metal may be greater than a mean diameter of the first conductive metal.

The method may further include, after the forming of the second resistance layer, sintering the second resistance layer.

The sintering may be sequentially performed in an oxidation atmosphere and a reduction atmosphere.

The reduction atmosphere maybe a hydrogen atmosphere.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
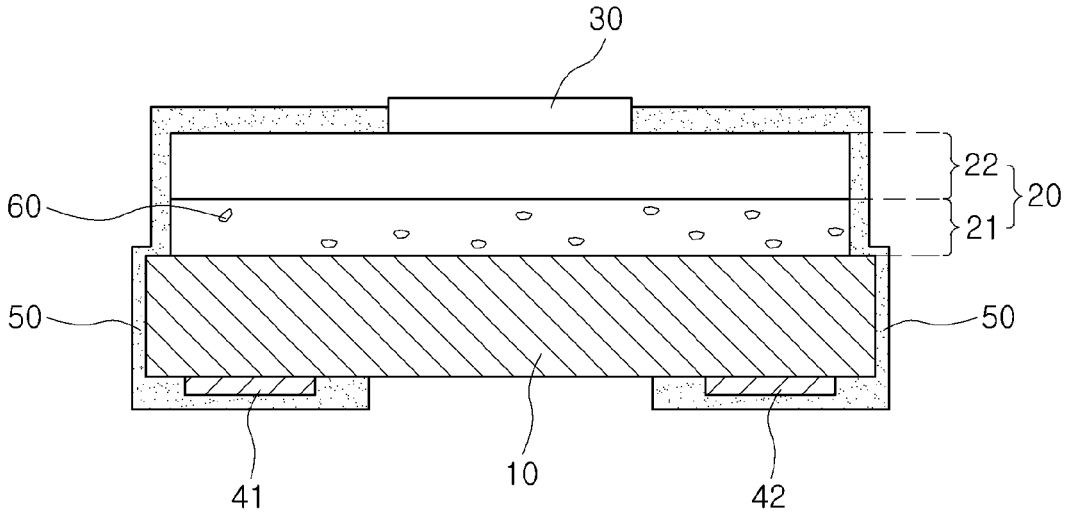
FIG. 1 is a cross-sectional view of a chip resistor according to an embodiment of the present invention.

Embodiments of the present invention will now be described in detail with reference to the accompanying drawings.

The embodiments of the present invention may be modified in many different forms and the scope of the invention should not be limited to the embodiments set forth herein.

Rather, these embodiments are provided so that this disclosure will be thorough and complete, and will fully convey the concept of the invention to those skilled in the art.

In the drawings, the shapes and dimensions may be exaggerated for clarity, and the same reference numerals will be used throughout to designate the same or like components.

FIG. 1 is a cross-sectional view of a chip resistor according to an embodiment of the present invention.

Referring to FIG. 1, the chip resistor according to an embodiment of the present invention may include a ceramic substrate 10; and a resistance layer 20 formed on the ceramic substrate 10.

The ceramic substrate 10 may refer to an electrical insulating substrate formed of a ceramic material. The ceramic substrate 10 maybe, but is not limited to, an alumina substrate.

The ceramic substrate 10 is not particularly limited as long as the ceramic substrate 10 may have excellent insulation, excellent thermal conductivity, and excellent adhesion with a resistance unit.

Lower electrodes 41 and 42 may be formed on a lower portion of the ceramic substrate 10. An external circuit may be connected with the lower electrodes 41 and 42.

The resistance layer 20 may include a first resistance layer 21 and a second resistance layer 22.

The first resistance layer 21 may be formed on the ceramic substrate 10 and may include a first conductive metal and a first glass.

The first conductive metal may include a copper (Cu)-nickel (Ni) alloy.

The first conductive metal may include at least one selected from the group consisting of gold (Au), silver (Ag), copper (Cu), nickel (Ni), tin (Sn), palladium (Pd), and an alloy thereof. However, precious metals such as Au, Ag, Pd, and the like are expensive and a Cu—Ni alloy is relatively inexpensive.

The first and second conductive metals may each have the content of Ni ranging from 18 to 70 wt %.

In order to use the Cu—Ni alloy for forming an integration-type resistor, the appropriate content of Ni to the Cu—Ni alloy may range from 18 to 70%.

Table 1 shows a temperature coefficient of resistance (TCR) and specific resistance of main metals. A TCR refers to a variation rate of a resistance value according to a temperature. In general, a TCR may be calculated by a variation rate of a resistance value in the range of −55° C., room temperature, and 125° C.

TABLE 1

| Metal | TCR ($\times 10^{-6}$ mm/° C.) | specific resistance (nΩ/m) |
|---|---|---|
| Sn | 4,600 | 10.1 |
| Pd | 3,900 | 10.5 |
| Ni | 6,800 | 6.2 |
| Ag | 4,100 | 1.47 |
| Cu | 4,300 | 1.58 |

Ni and Cu powders may be easily oxidized due to their good reactivity with oxygen. In particular, when Ni and Cu powders are exposed to air at a temperature of 300° C. or more, the Ni and Cu powders may react with oxygen contained in the air and may be oxidized, thereby degrading sinterability and alloy of Ni and Cu and increasing resistance of Ni and Cu.

The first resistance layer 21 may include the first glass. By adding the first glass to the first resistance layer 21, adhesion between the first resistance layer 21 and the ceramic substrate 10 may be increased.

The first resistance layer 21 may be formed on the ceramic substrate 10. The first resistance layer 21 may be formed of a metal and the ceramic substrate 10 may be formed of ceramic. Since a metal and a ceramic are different materials, adhesion between the metal and the ceramic may be relatively low.

By adding glass that is a kind of ceramic to a metal, a material difference between a metal and ceramic may be relieved, thereby increasing the adhesion between a metal and ceramic and increasing durability against external shocks.

In addition, by adding the first glass to the first resistance layer 21, a TCR of the first resistance layer 21 may be reduced. Since glass is a kind of ceramic, glass may have a relatively low TCR as compared with a metal. The TCR of the first resistance layer 21 may be reduced by as much as the content of the first glass that is added to the first resistance layer 21.

In short, by adding the first glass to the first resistance layer 21, the first resistance layer 21 may improve mechanical reliability and TCR properties of the chip resistor.

The content of the first glass may range from 3 to 40 parts by weight based on 100 parts by weight of the first conductive metal, and for example, may be 5 to 10 parts by weight based on 100 parts by weight of the first conductive metal.

When the content of the first glass is less than 3 parts by weight, since the adhesion between the first resistance layer 21 and the ceramic substrate 10 may be relatively low, the first resistance layer 21 may be peeled from the ceramic substrate 10 due to external shocks or the like and electrical properties of the first resistance layer 21 may be reduced. When the content of the first glass is greater than 40 parts by weight, the resistance of the first resistance layer 21 may be increased due to the added first glass.

A thickness of the first resistance layer 21 may range from 5 to 40 um.

When the thickness of the first resistance layer 21 is less than 5 um, an effect of increasing the adhesion between the first resistance layer 21 and the ceramic substrate 10 and reducing the TCR of the first resistance layer 21 may be relatively small.

When the thickness of the first resistance layer 21 is 40 um or more, printing accuracy may be reduced. In addition, when the first resistance layer 21 is fired, since organic components such as organic solvent or the like contained in the first resistance layer 21 may not be removed, the resistance of the first resistance layer 21 may be increased. In addition, since the first resistance layer 21 is relatively too thick, a trimming process may not be performed.

The second resistance layer 22 may be formed on the first resistance layer 21 and may include a second conductive metal and a second glass. The second resistance layer 22 may have a smaller content of glass than the first resistance layer 21. Alternatively, the second resistance layer 22 may not include glass.

The second resistance layer 22 may be designed in consideration of an effect of increasing adhesion with the first resistance layer 21 and reducing specific resistance.

The second conductive metal may include a Cu—Ni alloy and may have the same composition as the first conductive metal, thereby increasing adhesion between the second resistance layer 22 and the first resistance layer 21.

The second resistance layer 22 may not include glass or may include a smaller content of glass than the first resistance layer 21. By reducing the content of glass that is an electrical nonconductor, specific resistance of the second resistance layer 22 may be relatively reduced.

In addition, by increasing the thickness of the second resistance layer 22, the specific resistance of the second resistance layer 22 may be reduced. The thickness of the second resistance layer 22 may be increased by repeatedly printing a conductive paste or forming the second resistance layer 22 so as to have a greater mean diameter of Ni powder particles and Cu powder particles than in a case of the first resistance layer 21.

The second resistance layer 22 may be formed to have two or more separate layers. By forming the second resistance layer 22 to have two or more layers, the thickness of the second resistance layer 22 may be further increased and the resistance of the second resistance layer 22 may be reduced. For example, the second resistance layer 22 may be formed to have two layers.

Thus, in this case, the resistance layer 20 may include three layers.

When the second resistance layer 22 is formed to have two or more layers and the two or more layers have the same composition, since the two or more layers are integrated with each other after being sintered, it may not be easy to distinguish the two or more layers from each other. However, when the two or more layers have different compositions or have different contents of glass, the two or more layers may be distinguished from each other by a mapping method using an electron probe microanalyzer (EPMA) or the like.

The second resistance layer 22 may be thicker than the first resistance layer 21.

The first resistance layer 21 may be a layer formed to increase adhesion with the ceramic substrate 10 and to reduce a TCR. In addition, since the first resistance layer 21 includes glass, the first resistance layer 21 may have relatively high resistance. The second resistance layer 22 may be a layer formed to reduce resistance of the chip resistor and may not include glass or may include a relatively very small content of glass. Any defects do not arise in terms of adhesion with the ceramic substrate 10 and a TCR, the second resistance layer 22 may be formed to be thicker than the first resistance layer 21 so as to reduce resistance of the chip resistor.

The thickness of the second resistance layer 22 may range from 10 to 70 um. The total thickness of the first and second resistance layers 21 and 22 after being fired may be equal to or smaller than 110 um.

When the total thickness of the first and second resistance layers 21 and 22 after being fired is greater than 110 um, since the ceramic substrate 10 is excessively bent, the ceramic substrate 10 may be damaged during processes, thereby seriously reducing processability.

As the total thickness of the first and second resistance layers 21 and 22 is increased, the ceramic substrate 10 maybe bent due to shrinkage that occurs while metal is fired. This is because a degree of shrinkage of the first and second resistance layers 21 and 22 that mainly include metal is greater than that of the ceramic substrate 10.

A resistance-layer protective portion 30 may be formed on the resistance layer 20. The resistance-layer protective portion 30 may be formed by screen-printing borosilicate glass and then firing the borosilicate glass at a high temperature.

A conductive layer 50 may be formed to surround the ceramic substrate 10 and the resistance layer 20. The conductive layer 50 may be a plating layer, in particular, a Ni plating layer that is formed by an electroplating method.

According to another embodiment of the present invention, a method of manufacturing a chip resistor may include forming the first resistance layer 21 on the ceramic substrate 10 and forming the second resistance layer 22 on the first resistance layer 21.

The ceramic substrate 10 may be an alumina substrate.

The first resistance layer 21 may be formed of a first conductive paste containing a first glass. The second resistance layer 22 may be formed on the first resistance layer 21 and may be formed of a second conductive paste containing a second glass. The first and second resistance layers 21 and 22 may be formed by a printing method.

Alternatively, the second resistance layer 22 may not include glass.

The first and second conductive pastes may include Cu and Ni and may have the same composition of Cu—Ni.

A mean diameter of Ni powder particles may be ½ or smaller than a mean diameter of Cu powder particles.

When the first conductive metal is a Cu—Ni alloy, as the content of Ni is increased, a TCR is reduced. However, when the content of Ni is excessively large, since a sintering reaction between Cu and Ni may not proceed smoothly, a TCR may be increased.

This is because a sintering temperature of Ni is higher than a sintering temperature of Cu. In order to solve this defect, Ni powder particles of which a mean diameter is equal to or smaller than 1 um and is ½ or smaller than a mean diameter of Cu powder particles may be used, thereby preventing a sintering temperature from being increased due to Ni and increasing a sintering density.

Mean diameters of Cu particles and Ni particles contained in the second conductive paste may be greater, for example, twice greater than mean diameters of Cu particles and Ni particles contained in the first conductive paste, respectively.

As a mean diameter of conductive metal used in the second resistance layer 22 is increased, the number of printing processes may be reduced.

The method may further include sintering the second resistance layer 22 after forming of the second resistance layer 22.

The first resistance layer 21 and the second resistance layer 22 may be sintered at different temperatures.

That is, the first resistance layer 21 and the second resistance layer 22 may be separately fired. This is because the first resistance layer 21 includes glass and the second resistance layer 22 does not include glass or includes a relatively very small content of glass only.

When the second resistance layer 22 includes two or more layers, since the two or more layers have similar components or the same component, the two or more layers may be sintered under the same condition. That is, the two or more layers may be simultaneously fired. However, when the two or more layers each have a thickness of 50 um or more, the two or more layers may be separately fired.

When the two or more layers are simultaneously fired, relatively high productivity may be obtained. However, a density of the resistance layer 20 may be reduced and resistance of the resistance layer 20 may be increased.

The sintering of the second resistance layer 22 may be sequentially performed in an oxidation atmosphere and a reduction atmosphere. The reduction atmosphere may be a hydrogen atmosphere.

When a Ni—Cu paste is sintered, adhesion between the ceramic substrate 10 and the resistance layer 20 may not be sufficiently increased, Ni—Cu powders may not be sufficiently prevented from being oxidized, and Ni—Cu powders may not be sufficiently alloyed, in a nitrogen atmosphere only.

An entire atmosphere may be controlled by using nitrogen gas. In this case, an oxygen atmosphere for supplying oxygen may be required to adhere a de-binder, glass, and a metal to each other and a reduction atmosphere may be required to sinter metals and densify the resistance layer 20.

In particular, with regard to Ni, since fine particles are used and processes are performed at a relatively high temperature, oxidation may easily occur. A reduction atmosphere may be formed by using hydrogen or the like, thereby increasing a density of Ni—Cu and preventing oxidation.

The resistance-layer protective portion 30 may be formed on the second resistance layer 22. The conductive layer 50 may be formed to surround the resistance layer 20 and the ceramic substrate 10.

The ceramic substrate 10, the first and second resistance layers 21 and 22, the resistance-layer protective portion 30, the conductive layer 50, and the like, according to another embodiment of the present invention are the same as those according to the embodiment of the present invention described above.

Hereinafter, the present invention will be described in more detail with reference to an embodiment and a comparative embodiment.

A chip resistor according to an embodiment of the present invention was prepared as follows.

The first conductive paste for forming the first resistance layer 21 was prepared as follows.

First, Cu powders having a mean diameter of 0.5 um and Ni powders having a mean diameter of 0.18 um were prepared as conductive metals.

The Cu powders and the Ni powders were mixed so as to have a weight ratio of Cu and Ni of 55:45, and glass was added to the resulting material so as to have 5 parts by weight based on 100 parts by weight of the conductive metal (the total content of Cu and Ni).

An organic solvent and a binder were added to the resulting material and then ball milling was performed on the resulting material to prepare the first conductive paste.

The second conductive paste for forming the second resistance layer 22 was prepared by the same method as the method for forming the first conductive paste, except that the second conductive paste did not include glass and Cu powders having a mean diameter of 2.5 um and Ni powders having a mean diameter of 0.4 um were used.

Then, the first conductive paste was printed on an alumina substrate to form the first resistance layer 21 and then the first resistance layer 21 was sintered at a temperature of 900° C.

Then, the second conductive paste was printed on the first resistance layer 21. This printing operation was repeated twice to form the second resistance layer 22. Then, the second resistance layer 22 was sintered at a temperature of 950° C. The second resistance layer 22 was formed to have two layers.

Then, a borosilicate glass paste was printed on the second resistance layer 22 and then was sintered to form the resistance-layer protective portion 30.

Then, a Ni plating layer was formed to surround the alumina substrate, and the first and second resistance layers 21 and 22 by an electroplating method.

A TCR and sheet resistance of the chip resistor manufactured by the above-described method were measured.

Figure 2:
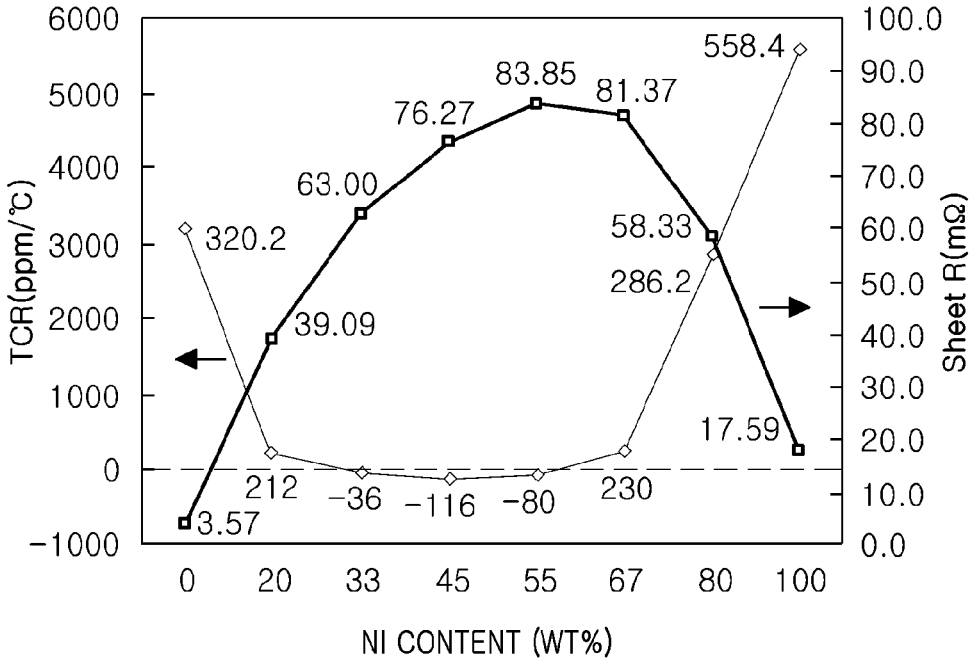
FIG. 2 is a graph showing a measured temperature coefficient of resistance (TCR) and sheet resistance of a chip resistor with respect to a content of nickel (Ni), according to an embodiment of the present invention.

FIG. 2 is a graph showing TCR properties and sheet resistance of a chip resistor including a resistance layer of a Cu—Ni alloy formed on an Al substrate, according to an embodiment of the present invention. The TCR properties and sheet resistance were measured while the content of Ni is changed from 0 to 100 wt %.

Referring to FIG. 2, it is confirmed that, when the content of Ni is 45 wt %, a TCR has a relatively smallest value.

Figure 3:
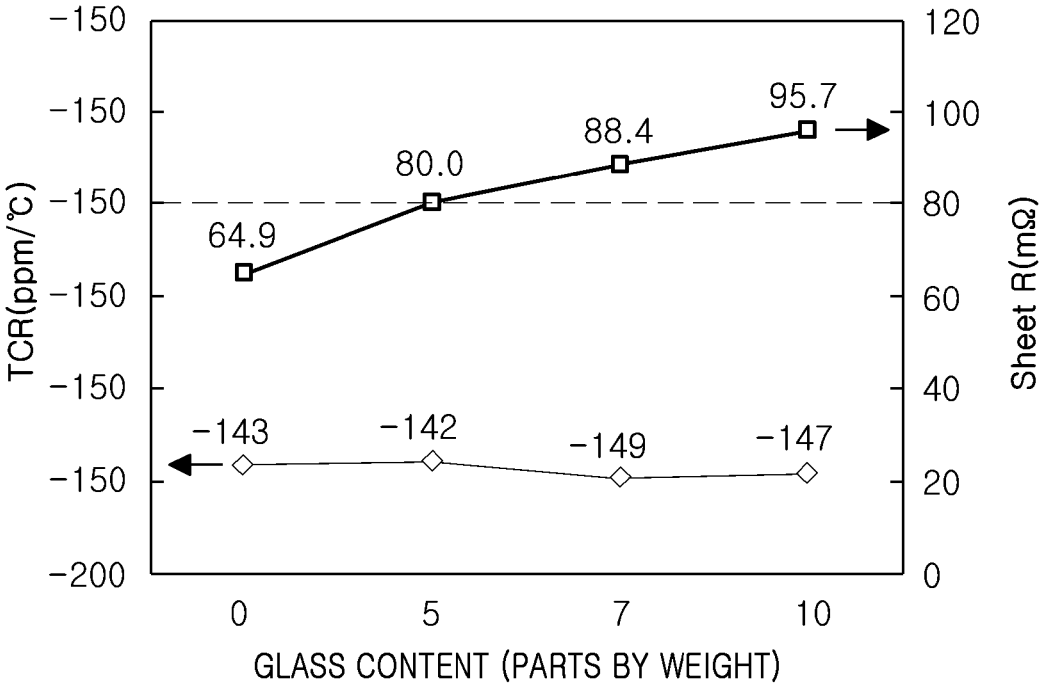
FIG. 3 is a graph showing a measured TCR and sheet resistance of a chip resistor with respect to a content of glass, according to an embodiment of the present invention.

FIG. 3 is a graph showing a TCR and sheet resistance of a chip resistor with respect to a content of glass, according to an embodiment of the present invention. In this case, the content of Ni is 45 wt %.

Referring to FIG. 3, it is confirmed that, as the content of glass is increased, the TCR is reduced and the sheet resistance is increased.

Table 2 shows the thickness of the resistance layer 20, resistance, and a TCR, which are measured as the number of printing processes is changed.

TABLE 2

| Number of printing processes | thickness of resistance layer (μm) | Resistance (mΩ) | TCR (ppm/K) |
|---|---|---|---|
| 2 | 55 | 13.7 | 12 |
| 3 | 73 | 10.1 | 31 |
| 4 | 84 | 8.9 | 33 |

As shown in Table 2, it is confirmed that, as the number of printing processes is increased, the resistance is reduced and the TCR is increased.

As set forth above, according to the embodiments of the present invention, a chip resistor having relatively low resistance and a relatively small TCR may be obtained.

The terminology used herein is for the purpose of describing particular embodiments only and is not intended to limit the inventive concept. As used herein, the singular forms "a" "an" and "the" are intended to include the plural forms as well, unless the context clearly indicates otherwise.

It will be further understood that the terms "comprises" or "comprising" when used in this specification, specify the presence of stated features, numerals, steps, operations, elements, or components, but do not preclude the presence or addition of one or more other features, numerals, steps, operations, elements, components, or groups thereof.

The present invention is not limited to the above-described embodiments and the accompanying drawings and is defined in the claims and their equivalents.

It will be apparent to those skilled in the art that substitutions, modifications and variations can be made without departing from the spirit and scope of the invention as defined by the appended claims and can also belong to the scope of the invention.

What is claimed is:

1. A chip resistor, comprising:

a ceramic substrate;

a first resistance layer disposed on the ceramic substrate and including a first conductive metal and a first glass; and a second resistance layer disposed on the first resistance layer, including a second conductive metal and a second glass, having a smaller content of glass than the first resistance layer, and having a thickness greater than a thickness of the first resistance layer.

2. The chip resistor of claim 1, wherein the second resistance layer includes two or more layers.

3. The chip resistor of claim 1, wherein the first conductive metal includes a copper (Cu)-nickel (Ni) alloy.

4. The chip resistor of claim 3, wherein a content of Ni of the first and second conductive metals ranges from 18 to 70 wt %.

5. The chip resistor of claim 1, wherein the second conductive metal includes a Cu-Ni alloy.

6. The chip resistor of claim 5, wherein a content of Ni of the first and second conductive metals ranges from 18 to 70 wt %.

7. The chip resistor of claim 1, wherein the first and second conductive metals have the same composition of the Cu—Ni alloy.

8. The chip resistor of claim 1, wherein a content of the first glass of the first resistance layer is 3 to 40 parts by weight based on 100 parts by weight of the first conductive metal.

9. The chip resistor of claim 1, wherein a thickness of the first resistance layer ranges from 5 to 40 um.

10. The chip resistor of claim 1, wherein a thickness of the second resistance layer ranges from 10 to 70 um.

11. The chip resistor of claim 1, wherein a total thickness of the first and second resistance layers is equal to or smaller than 110 um.

12. The chip resistor of claim 1, wherein the ceramic substrate is an alumina substrate.

13. A chip resistor, comprising:

a ceramic substrate;

a first resistance layer formed on the ceramic substrate and including a first conductive metal and glass; and a second resistance layer formed on the first resistance layer, including a second conductive metal, and not including the glass.

14. The chip resistor of claim 13, wherein the second resistance layer includes two or more layers.

15. The chip resistor of claim 13, wherein the first conductive metal includes a Cu-Ni alloy.

16. The chip resistor of claim 15, wherein a content of Ni of the first and second conductive metals ranges from 18 to 70 wt %.

17. The chip resistor of claim 13, wherein the second conductive metal includes a Cu-Ni alloy.

18. The chip resistor of claim 17, wherein a content of Ni of the first and second conductive metals ranges from 18 to 70 wt %.

19. The chip resistor of claim 13, wherein the first and second conductive metals have the same composition of the Cu—Ni alloy.

20. The chip resistor of claim 13, wherein a content of the glass of the first resistance layer is 3 to 40 parts by weight based on 100 parts by weight of the first conductive metal.

21. The chip resistor of claim 13, wherein a thickness of the first resistance layer ranges from 5 to 40 um.

22. The chip resistor of claim 13, wherein a thickness of the second resistance layer ranges from 10 to 70 um.

23. The chip resistor of claim 13, wherein a total thickness of the first and second resistance layers is equal to or smaller than 110 um.

24. The chip resistor of claim 13, wherein the ceramic substrate is an alumina substrate.

* * * * *